United States Patent [19]

Hashimoto et al.

[11] Patent Number: 4,508,459

[45] Date of Patent: Apr. 2, 1985

[54] CLOCK HAVING A ROTATIONALLY DISPLACEABLE CLOCK MOVEMENT

[75] Inventors: Masao Hashimoto; Katsumi Kato, both of Tokyo, Japan

[73] Assignee: Seikosha Co., Ltd., Tokyo, Japan

[21] Appl. No.: 400,709

[22] Filed: Jul. 22, 1982

[30] Foreign Application Priority Data

Aug. 4, 1981 [JP] Japan ..... 56-116070[U]

[51] Int. Cl.[3] ..... G04B 37/00

[52] U.S. Cl. ..... 368/276; 368/277

[58] Field of Search ..... 368/276, 10, 277

[56] References Cited

U.S. PATENT DOCUMENTS

| | | | |
|---|---|---|---|
| 2,838,905 | 6/1958 | Marble | 368/276 |
| 2,858,662 | 11/1958 | Ditesheim | 368/276 |
| 3,008,288 | 11/1961 | Marti et al. | 368/276 |
| 3,162,997 | 12/1964 | Schmidt | 368/276 |
| 3,853,216 | 12/1974 | Jaeschken | 368/276 |
| 4,205,521 | 6/1980 | Cazanas | 368/276 |

FOREIGN PATENT DOCUMENTS

| | | | |
|---|---|---|---|
| 540366 | 3/1956 | Italy | 368/276 |
| 57-61975 | 4/1982 | Japan | 368/277 |
| 57-61976 | 4/1982 | Japan | 368/277 |
| 57-61977 | 4/1982 | Japan | 368/277 |
| 57-61978 | 4/1982 | Japan | 368/277 |
| 274489 | 4/1951 | Switzerland | 368/10 |

*Primary Examiner*—Bernard Roskoski

*Attorney, Agent, or Firm*—Robert E. Burns; Emmanuel J. Lobato; Bruce L. Adams

[57] ABSTRACT

A clock can be used as a wall clock, as a desk clock or in some other using style. A clock unit is rotatably supported by a case, and a back plate is rotatably hinged to the case.

8 Claims, 8 Drawing Figures

FIG. 2
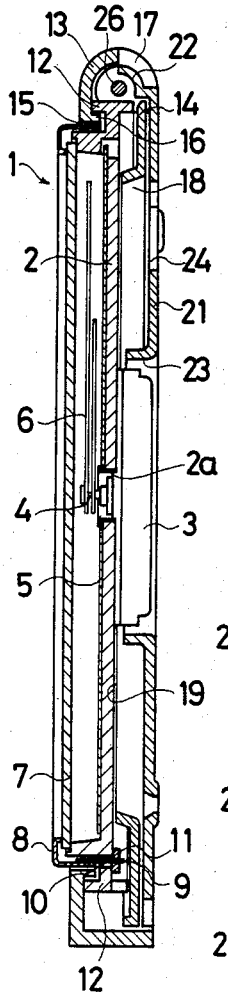
FIG. 3A
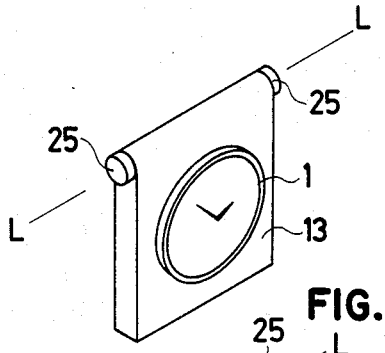
FIG. 3B
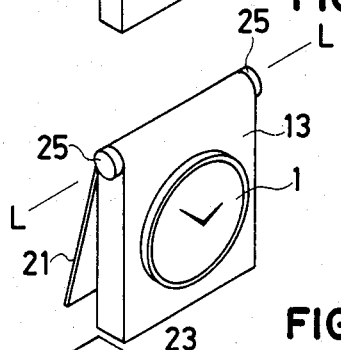
FIG. 3C
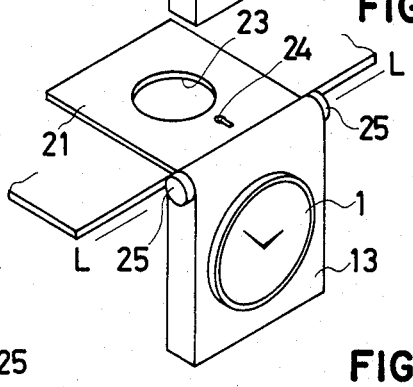
FIG. 3E
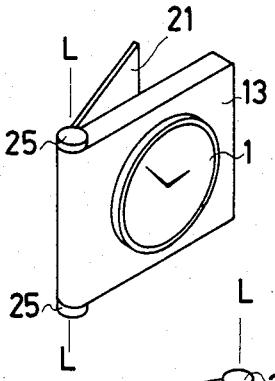
FIG. 3D
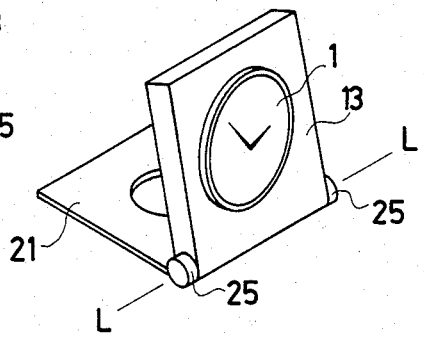
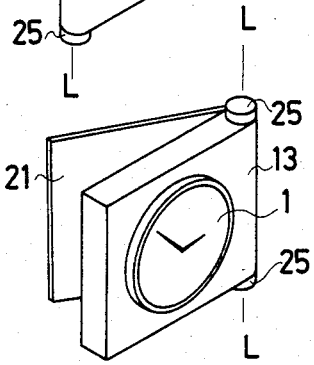
FIG. 3F

CLOCK HAVING A ROTATIONALLY DISPLACEABLE CLOCK MOVEMENT

BACKGROUND OF THE INVENTION

The invention relates generally to a clock, and more particularly to a clock which can be selectively placed in a variety of different modes or styles of use.

There are many types of wall clocks, desk clocks, pocket clocks and others. Each of these clocks has a single using style, for example a wall clock is used by hanging it on a wall. These prior art clocks have a fixed relation between the top and bottom of the clock. Accordingly, for example, a wall clock can only be used in the particular using style as a wall clock.

SUMMARY OF THE INVENTION

It is an object of the present invention to provide a clock which can be selectively used as a wall clock or as a desk clock.

It is another object of the present invention to provide a clock which can be selectively used in a variety of using styles by turning the clock upside down or by turning the clock leftward or rightward.

Other and further objects, features and advantages of the present invention will appear more fully from the following description.

BRIEF DESCRIPTION OF THE DRAWING

FIG. 2 is an enlarged vertical view, and

FIGS. 3A–3F are a series of is perspective views on a reduced scale showing various styles of use of the clock.

DETAILED DESCRIPTION OF THE INVENTION

Figure 1:
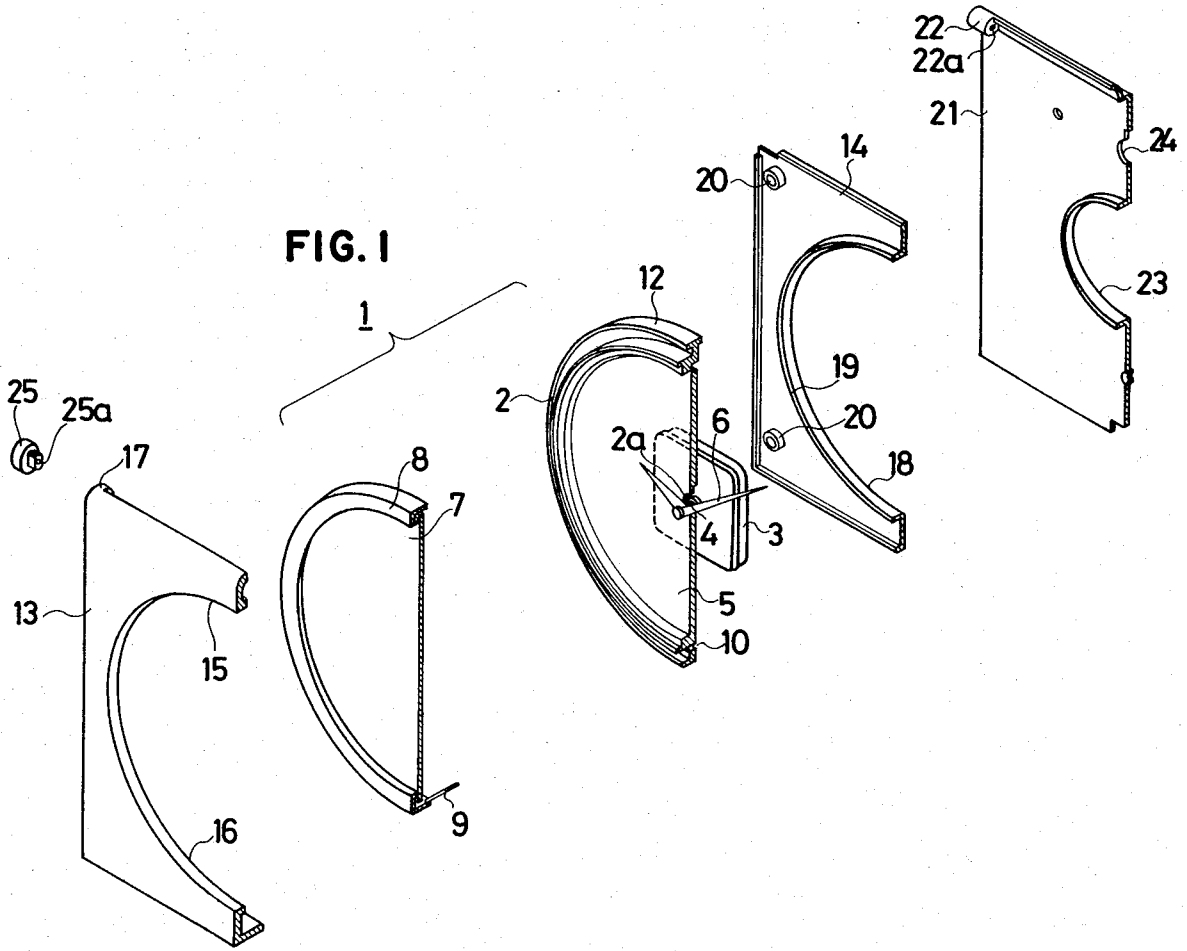
FIG. 1 is an exploded perspective view partly broken away.

In FIGS. 1 and 2, a clock unit 1 is composed of a movement 3 for keeping time fixed behind a dial trim 2. Hands 6 are fixed before a flat dial or clock face 5 to a hands-fixing shaft 4 which projects forward from a center hole 2*a* of the dial trim 2. A front cover 7 is attached to the dial trim 2 by a bezel 8 to come in contact with a front surface of the dial trim 2. The bezel 8 has some bezel supporters 9, which are inserted into holes 10 in the dial trim 2, and the bezel 8 is attached to the dial trim 2 by nuts 11 which are screwed to the bezel supporters 9. A belt-shaped supporting flange 12 is formed around the dial trim 2. The clock unit 1 is composed as described above.

The clock unit 1 is held between an intergally formed front case 13 and an integrally formed rear case 14, and is supported rotatably between the front case and the rear case to undergo rotational displacement relative to the case to any desired angular orientation. An attaching hole 15 is made in the front case 13, and the clock unit 1 projects from the attaching hole 15 and is visible therethrough. An inner circumference of the attaching hole 15 is bent backward to form a bending part 16 which can be inserted into a hollow of the supporting flange 12. A hinging part 17 is formed at both sides of one side (top side in this embodiment) in top, bottom, right and left sides of the front case 13. A through hole 18 is made in the rear case 14, and the movement 3 projects from the through hole 18. An inner circumference of the through hole 18 is bent forward to form a facing part 19 which faces a rear surface of the dial trim

2. The rear case 14 has a set of attaching parts 20, and the rear case 14 is integrally fixed to the front case 13 by screws (not shown) which are inserted into the attaching parts 20 to define an integral case structure, i.e., a case which is fixed together as a single unit.

A back plate member 21 is provided for hinged attachment to the front case 13 from behind the front case, and hinging parts 22 which connect to the hinging parts 17 are made at one side (top side in this embodiment) of the back plate. A through hole 23 is made in the center of the back plate 21. The movement 3 projects from the through hole 23. A hanging hole 24 is formed in the back plate 21 for enabling hanging the clock.

A set of hinging members 25 are non-rotatably attached to the hinging parts 17 of the front case 13 and hinging holes 25*a* are made in the hinging members 25 so as to align with hinging holes 22*a* in the hinging parts 22. Shafts 26 are inserted into the aligned hinging holes 22*a* and the hinging holes 25*a* and by such a construction the back plate 21 is rotatably hinged to the front case 13. In order to retain the back plate 21 at any desired angle, it is possible to employ friction members, click cams or some other known means near the hinging parts. It is not necessary to attach the back plate 21 to the front case and the back plate can instead be attached to the back case.

A description will now be given as to the manner of assembly of the clock. The movement 3 is fixed to the dial trim 2, the hands 6 are attached to the hands-fixing shaft 4, and the front cover 7 is attached to the bezel 8 to thereby construct the clock unit 1. After fixing the hinging members 25 to the front case 13, the front case 13 is set in front of the clock unit 1. When the bezel 8 of the clock unit 1 is inserted into the attaching hole 15 of the front case 13, the bending part 16 is inserted into the hollow of the supporting flange 12. Next the rear case 14 is set behind the clock unit 1, and is fixed to the front case 13 by screws or other suitable means. Consequently the clock unit 1 is rotatably supported between the front case 13 and the rear case 14. Next the back plate 21 is set behind the rear case 14, and the shafts 26 are inserted into the hinging holes 22*a* and the hinging holes 25*a*. Consequently the back plate 21 is rotatably hinged or pivotally connected to the front case 13. The clock is thus constructed as described above. Since the front surface of the clock unit 1 projects through the attaching hole 15, and the movement 3 extends into the through hole 18 of the rear case 14 and the through hole 23 of the back plate 21, the thickness of the clock is nearly equal to the thickness of the clock unit 1 and the thickness of the clock is not increased by the front case 13, the rear case 14 and the back plate 21.

When users use the clock, the clock can be selectively placed in any of the modes or styles illustrated in FIG. 3 at the choice of the user. FIG. 3A shows the first using style or operating mode as a wall clock. The wall clock can be hung by a nail which is fixed on a wall and is inserted into the hanging hole 24 of the back plate 21. In this style, a line L—L which is the pivotal axis of the hinging members 25, 25 becomes situated along the top side of the clock, and the relation between the top and the bottom of the clock unit 1 is the same as illustrated in FIGS. 1 and 2. FIG. 3B shows the second using style as a desk clock by rotating or pivoting the back plate 21. The angle of inclination of the clock is adjustable by rotating the back plate 21. FIG. 3C shows the third using style. In this style the back plate 21 is rotated through an angle of 90°, the back plate is then set on a desk or on a shelf, and the clock is maintained suspended by putting something heavy on the back plate 21. FIG. 3D shows the fourth using style. In this style the clock unit 1 is rotated 180° relative to the front and rear cases 13,14 and the back plate 21 so that the line L—L becomes the bottom side of the clock. The clock is used in a condition of inclination by resting the back plate 21 to the surface of the desk. FIG. 3E shows the fifth using style. In this style, the clock unit 1 is rotated or angularly displaced counterclockwise for 90° from the position shown in FIG. 3D, and the line L—L becomes the left side of the clock. The clock is used in the standing state by rotating the back plate 21. FIG. 3F shows the sixth using style. In this style, the clock unit 1 is rotated or angularly displaced for 180° from the position shown in FIG. 3E, and the line L—L becomes the right side of the clock. The clock is used in the standing state by rotating the back plate 21. As shown in the styles of use depicted in FIGS. 3E and 3F, the angular displacement of the clock unit 1 occurs in a plane which is parallel to the flat surface of the dial or clock face 5.

As described above, the clock of the present invention can be used as a wall clock, as a desk clock or in some other using style depending on the choice of the user.

The clock of the present invention can fulfill the wishes of users who prefer a variety of styles of use rather than a standardized using style.

Furthermore, the clock is simple in construction, thin in appearance and easy to use.

What we claim is:

1. A clock comprising: a clock unit having means for keeping and displaying time; a case having front and rear case portions connected together to define an integral case structure; means mounting the clock unit in the case to undergo angular displacement relative to the case about an axis which extends generally transversely of the front and rear case portions to enable the case to be angularly displaced relative to the clock unit about the aforesaid axis to different positions of use corresponding to different modes of use of the clock; and a plate member pivotably attached to the case and coacting therewith to help support the case in different positions of use corresponding to different modes of use of the clock.

2. A clock according to claim 1; wherein the means mounting the clock unit comprises means mounting the clock unit for rotational displacement relative to the case to enable the case to be angularly displaced about the aforesaid axis to any desired angular orientation relative to the clock unit.

3. A clock according to claim 1; wherein the clock unit includes a clock face on which the time is displayed; and the front case portion has an opening through which can be viewed the clock face.

4. A clock according to claim 1, wherein the means mounting the clock unit comprises a circular opening in the front case portion, and means on the clock unit for supporting the clock unit in the circular opening for angular displacement relative to the case.

5. A clock according to claim 1; wherein the clock unit has a generally flat clock face on which the time is displayed; and wherein the means mounting the clock unit comprises means mounting the clock unit for angular displacement in a plane which is generally parallel to the flat clock face.

6. A clock according to claim 1; wherein the clock unit has a generally flat clock face on which the time is displayed; and wherein the means mounting the clock unit comprises means mounting the clock unit for rotational displacement in a plane which is generally parallel to the flat clock face to enable the case to be angularly displced about the aforesaid axis to any desired angular orientation relative to the clock unit.

7. A clock according to claim 1; wherein the said axis intersects the plane of the front case portion at an angle approximately perpendicular thereto.

8. A clock according to claim 2; wherein the said axis intersects the plane of the front case portion at an angle approximately perpendicular thereto.

* * * * *